US005495629A

United States Patent [19]

Hüsler

[11] Patent Number: 5,495,629

[45] Date of Patent: Mar. 5, 1996

[54] SUPPORT GRID FOR SITTING OR LYING FURNITURE, AS WELL AS SUPPORT ELEMENTS FOR THE SUPPORT GRID

[75] Inventor: Balthasar Hüsler, Oberbipp, Switzerland

[73] Assignee: Studio Hüsler AG, Zug, Switzerland

[21] Appl. No.: 316,030

[22] Filed: Sep. 30, 1994

[30] Foreign Application Priority Data

Sep. 30, 1993 [CH] Switzerland ..... 2935/93

[51] Int. Cl.[6] ..... A47C 23/06

[52] U.S. Cl. ..... 5/236.1; 5/238; 5/239; 297/452.63

[58] Field of Search ..... 297/452.63, 452.64; 5/236.1, 238, 239

[56] References Cited

U.S. PATENT DOCUMENTS

| | | | |
|---|---|---|---|
| 2,842,778 | 7/1958 | Clauson | 5/239 |
| 3,813,713 | 6/1974 | Kipfer | 5/238 |
| 4,525,886 | 7/1985 | Savenije | 5/236.1 X |
| 4,682,378 | 7/1987 | Savenije | 5/239 |
| 4,827,544 | 5/1989 | Hüsler | 5/236.1 |
| 5,070,560 | 12/1991 | Wilkinson | 5/236.1 X |
| 5,127,114 | 7/1992 | Hörburger | 5/238 X |
| 5,210,889 | 5/1993 | Wesemann et al. | 5/236.1 |
| 5,233,709 | 8/1993 | Horry | 5/236.1 |
| 5,332,461 | 7/1994 | Huesler | 5/236.1 X |

*Primary Examiner*—Peter M. Cuomo
*Assistant Examiner*—Rodney B. White
*Attorney, Agent, or Firm*—Walter C. Farley

[57] ABSTRACT

The support grid for a lying, reclining or sitting furniture, particularly for a bed, according to the present invention comprises a plurality of support elements (1), e.g., laths, and at least two spring bodies (2), the latter being positioned transversely to the laths, the laths rest on the spring bodies and are fastened thereto. The laths have in cross-section a curved support under surface and are so fixed to the spring bodies that they can be pivoted to a limited extent with respect to the spring bodies about an axis running parallel to the longitudinal lath axis. As a result of this pivoting possibility each lath is given a further degree of freedom making it possible for it to adapt further to the shape of a body resting on the lath grid than is possible through the elasticity of the spring body. This increases the lying of sitting comfort of the support grid according to the invention.

16 Claims, 4 Drawing Sheets

SUPPORT GRID FOR SITTING OR LYING FURNITURE, AS WELL AS SUPPORT ELEMENTS FOR THE SUPPORT GRID

FIELD OF THE INVENTION

The invention is in the field of furniture manufacture and relates to a support grid for sitting, lying or reclining furniture, more especially for beds, as well as support elements, particularly laths, for such a support grid.

BACKGROUND OF THE INVENTION

According to the prior art, support grids are used as the supporting or carrying elements for beds. The grids e.g., comprise laths, which are fixed in resilient or stiff manner to a bed frame or to longitudinal beams or bars of such a frame or are resiliently mounted and the bed is transversely covered in the prestressed or relieved state. Normally on the lath grid is placed a mattress and the lath grid and mattress together form the carrying and springy support on which a person can comfortably sit or lie. The lath grid assumes the carrying function and the mattress the elastic function adapting to a body contour. The lath grid must have a minimum mechanical strength, but is advantageously and simultaneously resilient to a limited extent.

The demands made on the elastic qualities of the support grid increase if the mattress becomes thinner. For reasons of hygiene, handling, orthopedics and particular elastic qualities of mattresses there is a need for creating ever thinner mattresses, i.e., the elastic and adaptation function is transferred in an ever increasing extent to the support grid. For the same carrying or bearing capacity a lath grid can be given a more resilient and adaptable form, if e.g., a larger number of finer laths are used, but this makes the lath grid much more expensive. A design of the fastenings between the frame and the laths in the form of a bearing permitting a vertical movement of the laths and also a limited pivoting movement of the laths about their own longitudinal axis fulfil the same function. However, fastenings which are constructed e.g., in the form of complicated, articulated rubber devices are expensive.

Despite very stiff laths and very simple lath fastenings lath grids, whose laths, which are firmly fixed to at least two spring bodies parallel to the bed longitudinal axis, e.g., beam-like bodies made from an elastic material such as latex, have very good springy characteristics. The spring bodies then rest on the longitudinal beams of a bed frame or can also be placed directly on the floor. When the grid is loaded spring bodies enable the laths to perform movements in the vertical direction, together with limited pivoting movements about their longitudinal axes. Lath grids based on this principle are e.g., commercially available under the trade names "Liforma" and "Marmotli" and have very good elastic and adaptation properties, so that they can be comfortably used with very thin mattresses.

However, even with these grids, it is found that narrower laths lead to greater comfort than wider laths, i.e., with a minimum of costs a higher, but more restricted comfort is attainable and that said comfort could be further improved with narrower laths.

SUMMARY OF THE INVENTION

An object of the invention is to bring about such an improvement towards higher comfort, but without the extra costs of the narrower laths (supporting elements), i.e., to provide a support grid for a sitting or lying furniture, particularly a bed, which for the same width of the support elements offers a higher comfort, even if the support elements are fixed or mounted in a very simple manner.

The support grid according to the invention comprises a plurality of support elements, e.g., made from wood, i.e., laths. The support elements are referred to hereinafter as laths, but can also be made from materials other than wood, e.g., plastic, bamboo canes, etc.

The support grid according to the invention is based on the aforementioned lath grid, in which the laths in stiff or slightly elastic form are fixed to at least two spring bodies. Contrary to the prior art, the laths of the support grid according to the invention do not have a substantially rectangular cross-section, nor are they solidly fixed to the spring bodies. Instead they are shaped and fixed in such a way that they can move with respect to the spring bodies, specifically in a limited pivoting movement about a pivot axis, which is substantially parallel to the longitudinal axis thereof.

As a result of this limited pivoting movement, which is possible independently of local spring body deformations, each lath is given an additional degree of freedom, i.e., in addition to a vertical displacement associated with a deformation of the spring body and a pivoting mainly produced by the weight profile of the body resting on the lath grid, each lath can be further pivoted independently of the spring bodies, which permits a further and finer adaptation of the laths to the details of the shape profile of the lying or resting body.

The cross-section of the laths of the support grid according to the invention at least in the vicinity of the bearing of the laths on the spring bodies, has a generally convex support under-surface forming a rocking or swinging profile, i.e., the side of the lath cross-section facing the spring bodies has a profile, in which the central area (bearing area) is further removed from a line connecting the narrow sides than the outer areas. The rocking profile is e.g., an arc, the center of a circle being positioned above the center of the lath. The rocking profile is advantageously such that the lath, if it rests freely on a planar bearing surface with the rocking profile directed downwards, in an unstable equilibrium on its central area (bearing area or bearing edge) is in a position symmetrical to the median perpendicular of the lath cross-section.

As a function of the material used, the lath with the rocking profile preferably has a thickness of 5 to 20 mm.

In the support grid according to the invention laths (support elements) with such a rocking profile are fixed in the central area (bearing area or edge) resting on the spring bodies with a movable fastening in such a way that by a pressure acting asymmetrically to the median perpendiculars thereof they can be pivoted with respect to the spring bodies about the fastening.

BRIEF DESCRIPTION OF THE DRAWINGS

The support grid according to the invention and its function are described in greater detail hereinafter relative to the drawings, wherein.

DESCRIPTION OF THE PREFERRED EMBODIMENTS

Figure 1:
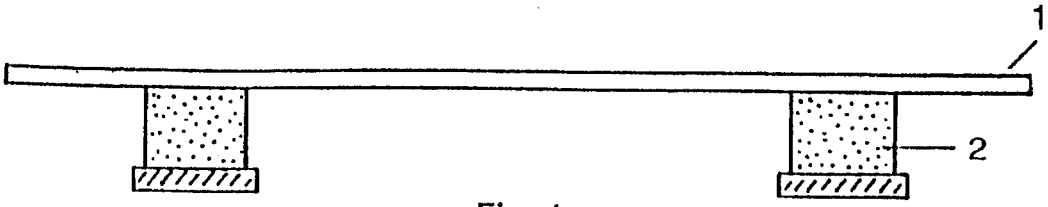
FIG. 1 is an end elevation of an embodiment of a support grid in accordance with the invention viewed in a direction parallel with the laths.
Figure 2:
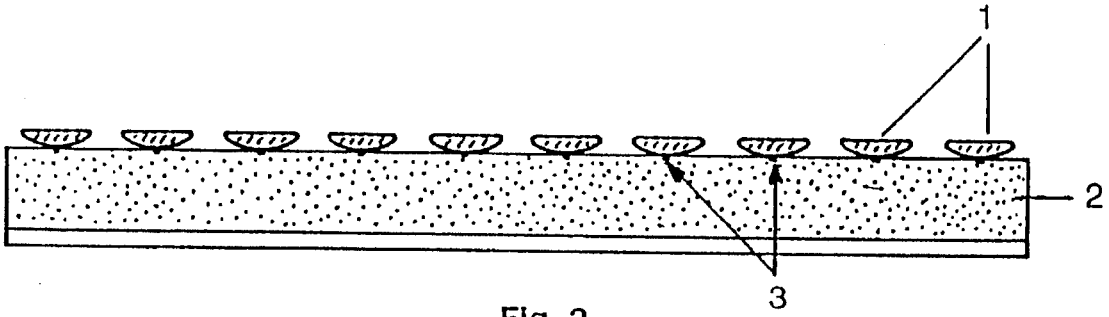
FIG. 2 is a side elevation of the support grid of FIG. 1 viewed in a direction perpendicular to the laths in the vicinity of a spring body.

FIGS. 1 and 2 show an embodiment of a support grid according to the invention in section parallel to the laths (FIG. 1) and transversely to the laths in the vicinity of a spring body (FIG. 2). The support grid according to the invention comprises a plurality of inherently non-elastic or only very slightly elastic laths (support elements) 1 and at least two elastic spring bodies 2, which are at right angles to the laths and e.g., in the form of latex beams, the laths being fixed to the spring bodies. The fastenings 3 of the laths to the spring bodies are diagrammatically indicated in FIG. 2. As can be gathered from FIG. 2, the laths 1 of the illustrated embodiment have in cross-section a rocking profile, i.e., the side thereof facing the spring body only rests on a central area (bearing edge or area) on the spring body and is so fixed thereto that to a limited extent the lath 1 can be pivoted with respect to the spring body 2 about the fastening 3.

Figure 3:
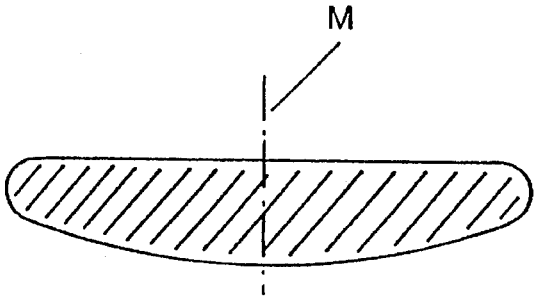
FIGS. 3–6 are transverse sectional views of laths showing various shapes thereof to form rocking profiles to form a support grid in accordance with the invention.

FIGS. 3 to 6 show different, exemplified rocking profiles for laths (support elements) for the support grid according to the invention. FIG. 3 shows on a larger scale the lath of FIG. 1 and 2. The rocking profile comprises an arc, whose center is positioned above the lath on the median perpendicular of the lath cross-section. Obviously the rocking profile need not be a precise circular arc and can instead be some other convex curve, which is advantageously symmetrical with respect to the median perpendicular M of the lath.

Figure 4:
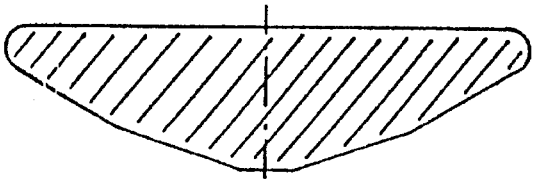
Figure 5:
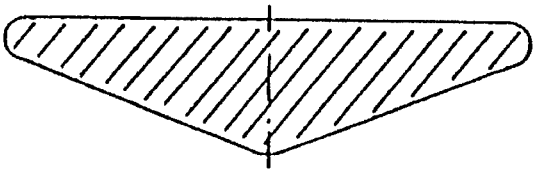

FIG. 4 shows as a rocking profile part of a polyhedron, which is also convex and advantageously symmetrical to the lath median perpendicular M. FIG. 5 also shows a simple rocking profile comprising two lines inclined against one another and which in the central area of the lath form a bearing edge.

Figure 6:
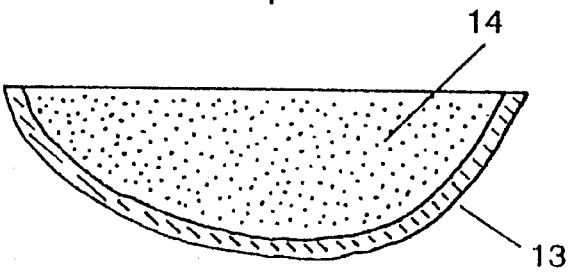

FIG. 6 shows a support element, which in the narrowest definition of the word is not a lath. It is a longitudinally cut (e.g., cut in half) bamboo cane or other tube 13, which is filled with a suitable filler 14, e.g., latex.

The upper surface of the lath of the support grid according to the invention and which is remote from the spring body can be given any random shape. Advantageously it is in the form of a planar surface and rounded where it meets the rocking profile. As indicated hereinbefore it is sufficient if the lath is only provided with a rocking profile where it rests on the spring bodies. However, as it is simpler from the manufacturing standpoint to make the rocking profile over the entire lath length, the lath advantageously has the same cross-sectional profile over its entire length. Once the manufacturing tools are set up for the manufacture of a rocking profile, the manufacture of such laths is no more complicated than the manufacture of laths with a substantially rectangular cross-section.

The fastenings of the laths to the spring bodies must be such that the laths are as free as possible, i.e., can be pivoted with respect to the spring bodies whilst expending minimum forces. Such a pivoting movement of the lath is only possible if the fastening and/or that part of the spring body on which it is fastened is sufficiently flexible. However, as the spring bodies are made from an elastic material (latex) and are normally surrounded by a fabric or cloth envelope, said area is sufficiently flexible. For a further increased pivoting possibility it is advantageous to have an automatically flexible lath fastening.

Figure 7:
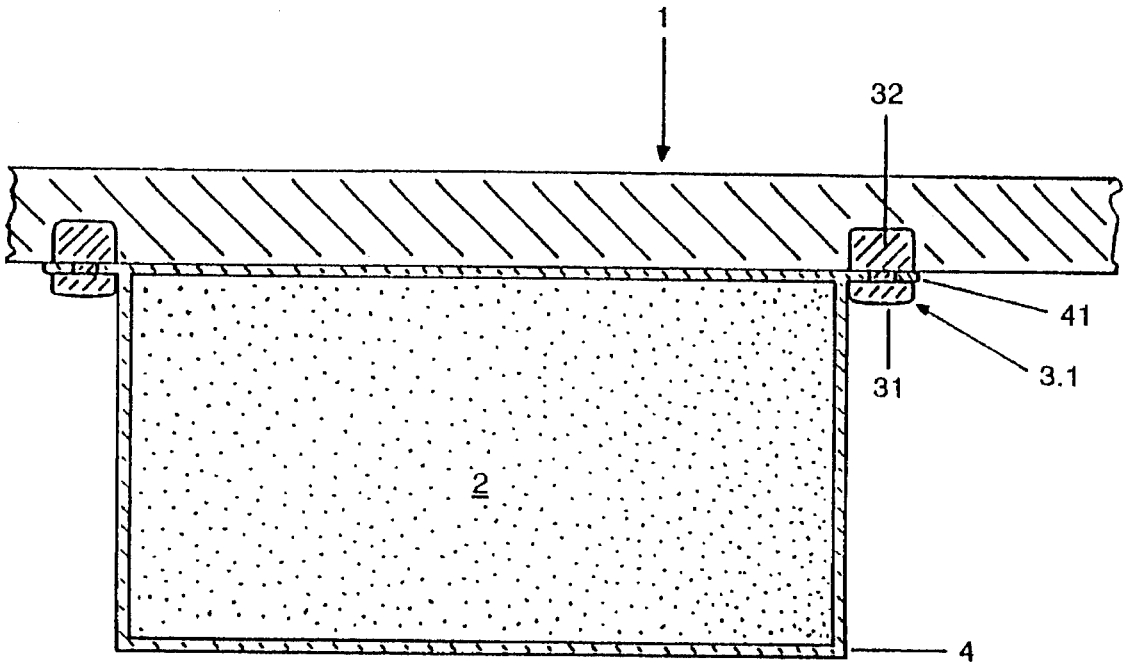
FIG. 7 is an enlarged end elevation, partially in section, of an embodiment of a lath fastening in accordance with the invention.
Figure 8:
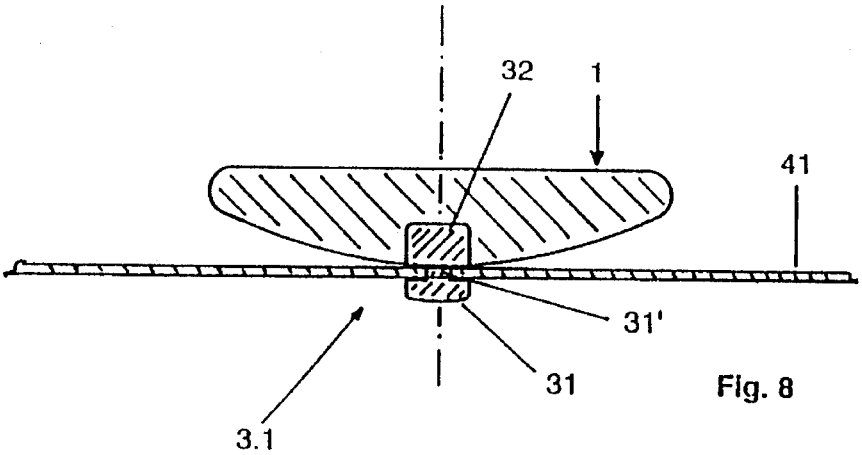
FIG. 8 is a side elevation of the fastening of FIG. 7.
Figure 9:
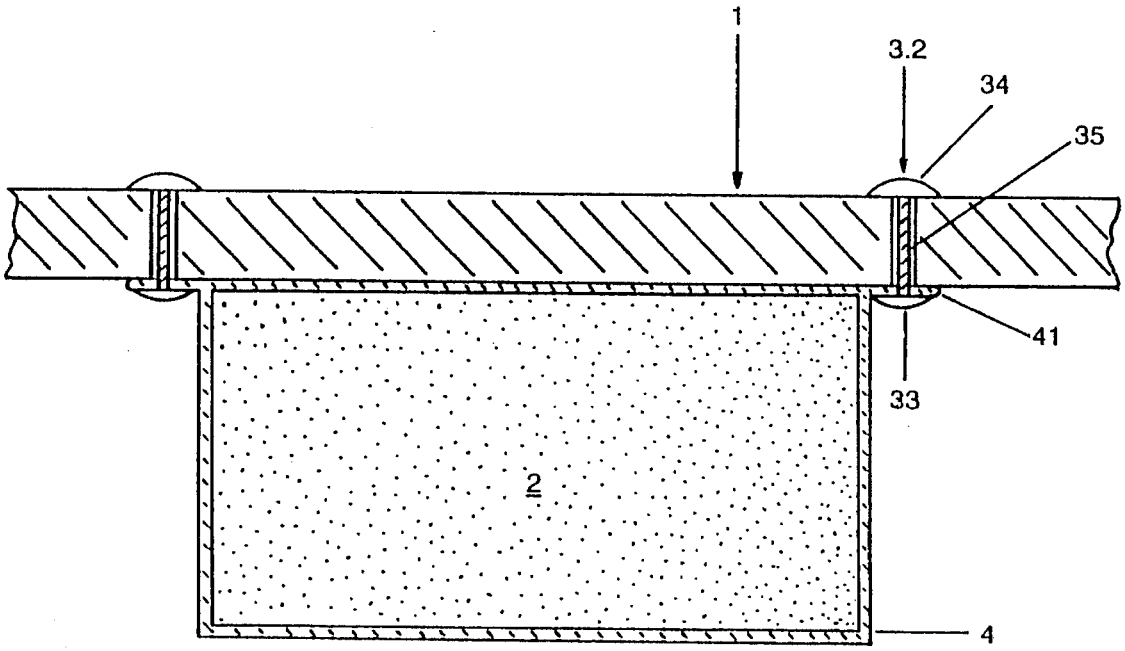
FIG. 9 is a view similar to FIG. 7 of a further embodiment of a fastening arrangement.
Figure 10:
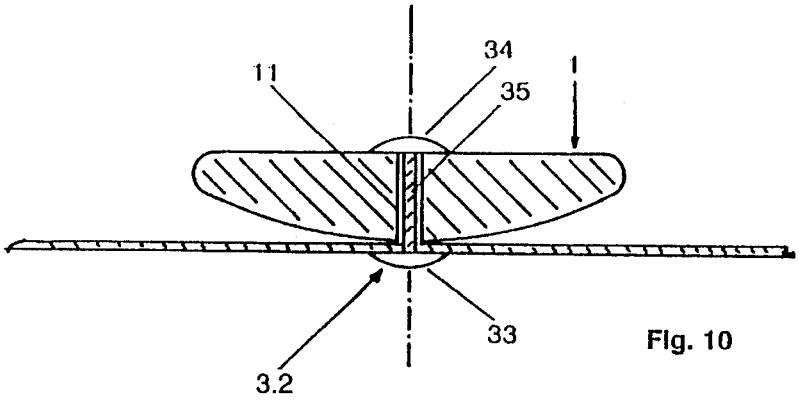
FIG. 10 is a view similar to FIG. 8 of the embodiment of FIG. 9

FIGS. 7 to 10 show two embodiments of lath fastenings, as viewed at right angles to a lath (FIG. 7 and 9) and on the other as a cross-section through a lath (FIG. 8 and 10).

Both embodiments of lath fastenings (3.1 and 3.2) have per lath and spring body two buttons (31, 33), which are inserted in buttonholes of in each case one flap or tongue 41, said tongues 41 running along the two edges of the spring bodies 2 facing the laths. The tongues can, as shown, be parts of a fabric envelope 4 completely surrounding each spring body, but can also be fastened to the corresponding edges of the spring bodies in some other way. The fastening to both sides of the spring body is advantageous, but not absolutely necessary. Basically a one-sided fastening in the indicated manner could take place.

In the embodiment according to FIG. 7 and 8 the button 31 is shaped or fixed by means of a neck 31' to a stud 32, which is embedded in the lath and glued in. In the embodiment according to FIG. 8 and 9 the button 33 is connected by means of a stiff or elastic neck portion 35 to a counterbutton 34, the latter being located on the top of the lath 1 and the neck portion 33 is guided through an opening 11 through the lath. If the neck portion 35 is stiff, the button 33 or counterbutton 34 must be engaged on the neck portion 35 during assembly. However, if the neck portion 35 is flexible the buttons 33 and/or 34 and the opening 11 through the lath can be provided in such a way that one of the buttons is guided e.g., in angled manner through the opening 11.

Simpler variants of the lath fastenings shown in FIG. 7 to 10 comprise the laths being fixed with the aid of in each case at least one nail, screw, clip or rivet in direct manner to the tongues 41. These variants are readily conceivable for the expert and are consequently not illustrated by drawings.

Figure 11:
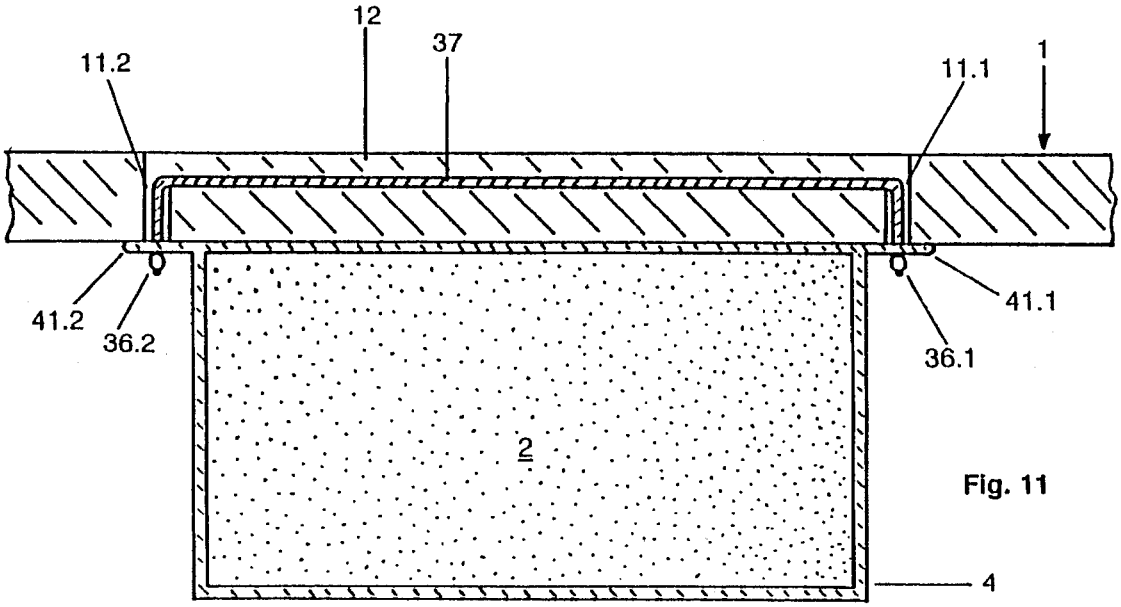
FIG. 11 is an end elevation of yet another embodiment of a lath fastening arrangement in accordance with the invention using two buttons and a flexible strip between the buttons.
Figure 12:
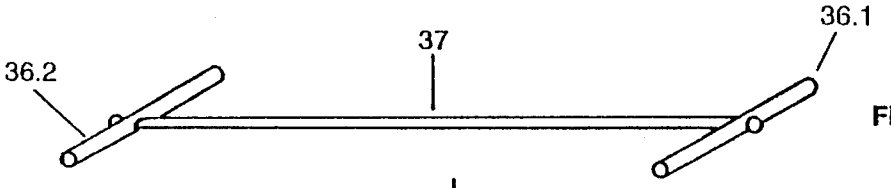
FIG. 12 is a perspective view of the fastening arrangement of FIG. 11.
Figure 13:
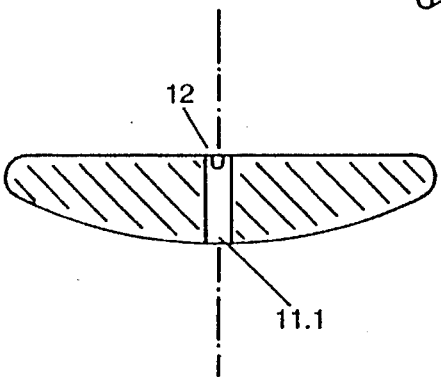
FIG. 13 is a side elevation of the fastening arrangement of FIG. 11.

FIGS. 11, 12 and 13 show a further embodiment of a lath fastening, which is once again based on the cooperation of in each case one button 36.1, 36.2 with a buttonhole in in each case one tongue 41 on either side of the spring body 2. The two buttons 36.1 and 36.2, with which a lath 1 is fixed to a spring body 2, respectively to tongues 41.1 and 41.2 running along the spring body edges, are interconnected with a flexible, elastic or inelastic strip 37. The strip 37 passes into a slit 12 located on the top of the lath and through two openings 11.1, 11.2 passing through the lath. As shown, the buttons 36.1 and 36.2 can be bar-shaped, so that for assembly purposes they can be guided in an angled position and in simple manner through the openings 11.1 and 11.2. If the strip 37 is not elastic, at least one of the buttons 36.1, 36.2 must be fixed thereto during assembly.

Obviously lath fastenings other than those shown and described are possible, provided that they fulfil the condition of the pivotability of the lath with respect to the spring body. The described and illustrated embodiments all have the-advantage that they can be easily manufactured from natural materials such as solid wood, cotton, latex, etc. The laths with the rocking profile are also advantageously made from solid wood, so that the support grid according to the invention not only fulfills the set problem with respect to the economics of manufacture, but can also meet high ecological demands.

I claim:

1. A support grid for sitting or lying furniture comprising at least two elongated spring bodies extending generally parallel with each other;

a plurality of support elements extending generally perpendicular to said spring bodies and resting on upper surfaces of said spring bodies, each of said support elements comprising an elongated member having a generally planar upper surface and a lower surface shaped, at least at areas of contact with said spring bodies, so that, in cross-section, said elongated member is thicker along a longitudinal midline of said member than along longitudinal side edges of said member so that said member makes contact with said spring bodies along a linear area much narrower than a width of said member when not supporting a load; and a plurality of fastener means flexibly holding said support elements to said spring bodies so that each said support element is restrained against longitudinal movement relative to said spring bodies and is movable in a rocking motion on said spring bodies.

2. A support grid according to claim 1 wherein each of said support elements comprises a wooden lath.

3. A support grid according to claim 2 wherein each said lath comprises solid wood.

4. A support grid according to claim 1 wherein said lower surface of each said support element is shaped symmetrically relative to a longitudinal central plane through said element perpendicular to said upper surface of said element.

5. A support grid according to claim 4 wherein said lower surface lies in a generally circular cylinder having a center in said longitudinal central plane.

6. A support grid according to claim 4 wherein said lower surface lies in the surface of a polyhedron.

7. A support grid according to claim 4 wherein said lower surface lies in two intersecting planes intersecting at said longitudinal central plane.

8. A support grid according to claim 1 wherein each of said support elements comprises a semi-cylindrical body having an interior volume filled with a selected resilient material.

9. A support grid according to claim 8 wherein said semi-cylindrical body is a bamboo cane.

10. A support grid according to claim 1 wherein each said spring body has a laterally extending tongue adjacent said lower surface of said support elements, and wherein said fastener means includes a plurality of fasteners attached to said tongue.

11. A support grid according to claim 10 and further comprising a fabric cover enveloping each said spring body, and wherein said tongue is formed from a part of said fabric cover.

12. A support grid according to claim 11 wherein said fasteners are rivets.

13. A support grid according to claim 11 wherein each said tongue comprises means defining buttonholes therethrough, and wherein each said fastener comprises a button extending through one of said buttonholes.

14. A support grid according to claim 13 wherein each said fastener further comprises a second button adjacent an upper surface of one of said support elements and a connector between said buttons.

15. A support grid according to claim 13 wherein each said spring element includes tongues extending laterally from opposite sides of said element, each said tongue having openings therethrough, and wherein said fastening means comprises first and second buttons and a flexible strip extending between said buttons, said strip passing from a button through one tongue, through two openings in one of said support elements and through the other tongue to the second button.

16. A support grid according to claim 1 wherein said lower surface is shaped along its entire length so that, in cross-section, said elongated member is thicker along a longitudinal midline of said member than along longitudinal side edges of said member.

* * * * *